United States Patent [19]

Bishop et al.

[11] 4,023,685

[45] May 17, 1977

[54] BILLET MANIPULATOR

[75] Inventors: Earl L. Bishop, Cuyahoga Falls; James L. Giffels, Akron, both of Ohio

[73] Assignee: Akron Standard, division of Eagle-Picher Industries, Inc., Akron, Ohio

[22] Filed: Dec. 15, 1975

[21] Appl. No.: 640,491

[52] U.S. Cl. ..... 214/1 QG; 198/413; 214/130 R

[51] Int. Cl.[2] ..... B65G 7/00

[58] Field of Search ..... 214/1 QG, 1 Q, 130 R; 198/283, 284, 285, 286, 410, 411, 413

[56] References Cited

UNITED STATES PATENTS

| | | | |
|---|---|---|---|
| 3,719,286 | 3/1973 | Kazuba | 214/1 QG |
| 3,726,420 | 4/1973 | Stratton | 214/1 QG |

*Primary Examiner*—Robert J. Spar
*Assistant Examiner*—George F. Abraham
*Attorney, Agent, or Firm*—Wood, Herron & Evans

[57] ABSTRACT

Apparatus for rotating a billet. A frame presents an upwardly facing surface to support a billet, the surface having a slope so that the rectangular billet presents a surface which slopes toward an operator for the purpose of grinding and the like. The frame supports a plurality of lift arms having L-shaped ends which are adapted to engage a corner of a billet and lift the billet to cradle it for corner grinding and then to lower the billet to present a new surface for grinding. The frame also carries a plurality of clamp arms for engaging one side of a billet and pushing it against an abutment projecting above the surface of the frame to clamp it there during the grinding operation. The frame also supports a plurality of eject arms mounted on a common shaft for discharging a billet from the frame.

11 Claims, 8 Drawing Figures

BILLET MANIPULATOR

This invention relates to a billet manipulator.

In the grinding of billets which are quite large, as for example, up to thirty feet long and sixteen inches square, the billets are placed on a car and moved past a grinding wheel where the scale formed on the surface of the billet from its manufacture is removed. The car is slowly moved longitudinally past a grinding station where an operator causes a grinding wheel to move transversely back and forth over the surface of the billet as the billet car conveys the billet under the grind wheel. After each pass of the billet through a grinding operation, the billet is rotated to present a fresh surface for grinding.

An objective of the present invention has been to provide an improved billet manipulator and particularly one which provides greater capability of viewing the surface being ground, and which provides greater capability for corner grinding with reduced complexity of the manipulator mechanism.

To this end, the invention provides a frame presenting an upwardly facing supporting surface. A plurality of lift arms are pivotally mounted on the frame for movement up underneath a supported billet to rotate the billet with respect to the supporting surface. The ends of the lift arms are L-shaped so as to cradle the billet in the notches formed by the L-shaped arms when the billet is initially raised. In this cradled attitude, the billet has been rotated through about 45° to present an upwardly facing corner for corner grinding if desired. When the lift arms are lowered, the billet rotates through another angle to present an adjacent fresh side in an upwardly facing attitude for grinding.

The invention further provides a supporting frame having a downwardly sloping surface the operator of the grinding wheel. At least two advantages may be attributed to the downwardly sloping surface. First, it presents the surface in a better attitude for viewing by the operator as he performs his grinding operation. Second, in supporting the billet on a sloping surface, the corner of the billet remote from the operator is at least slightly upwardly projecting so as to permit corner grinding without requiring a separate pass of the billet when it is cradled in a 45° attitude, as described above.

The invention further provides an abutment projecting above the supporting surface and a movable clamp to engage the side of the billet and push it against the abutment to clamp the billet there during the griding operation.

The invention further provides ganged eject arms mounted on a common shaft and presenting free ends above the frame supporting surface which are adapted to engage the side of a billet and push it off the billet car without cocking the billet as it moves off the car.

The several features of the invention will become more readily apparent from the following detailed description taken in conjunction with the accompanying drawings in which.

Figure 1:
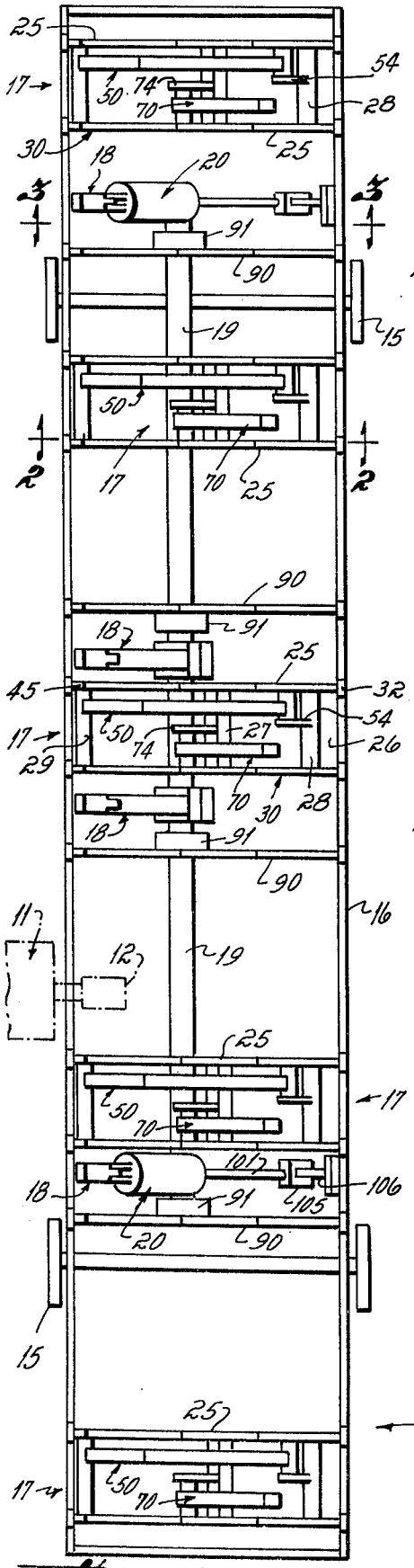
FIG. 1 is a plan view of a billet car utilizing the present invention.

Referring to FIG. 1, there is shown a billet car 10 located adjacent a grinding station 11 which supports a grinding wheel 12 for transverse movement with respect to the car 10. The car is mounted on four large wheels 15 which engage tracks to permit the car to be rolled past the grinding station 11. Any suitable drive mechanism such as a rack and pinion (not shown) may be used to cause the car to be moved past the grinding station. The car includes a generally rectangular frame 16 within which are supported five lift and clamp modules 17 and four eject arms 18. The eject arms, which will be described in more detail below, are all fixed to a common shaft 19 operated by two hydraulic rams 20 located at each end of the car.

Figure 2:
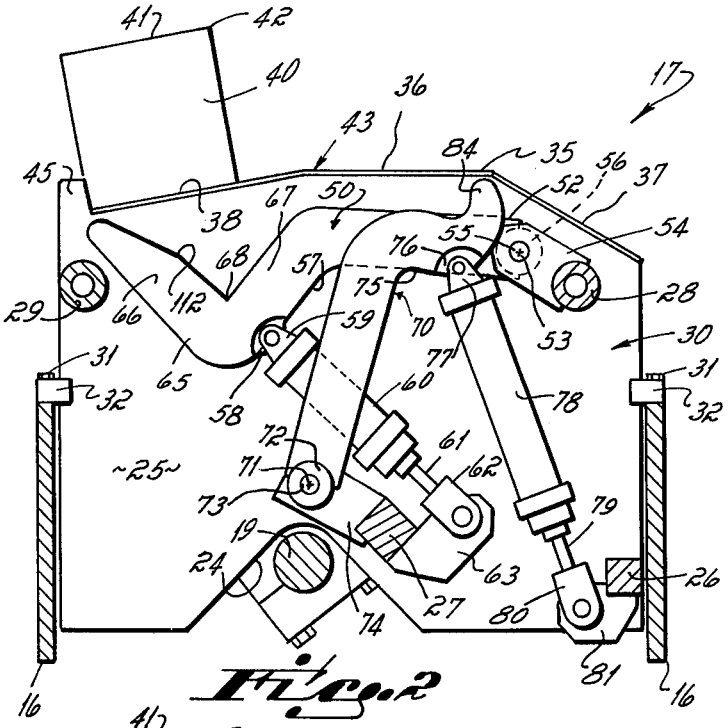
FIG. 2 is a cross-sectional view taken along lines 2—2 of FIG. 1 showing the lift and clamp arms.

The lift and clamp module 17 is shown in FIG. 2. Each module includes two vertical plates 25 joined to the frame 16 and forming a part of the frame. The plates are spaced apart and are joined together by fixed blocks 26 and 27 and fixed tubes 28, 29. The lower edges of the plates are notched out as at 24 in order to permit the passage of the shaft 19 for the eject arms. The plates provide a supporting frame 30 joined to the billet car frame 16 by bolts 31 passing through brackets 32 projecting from each plate 25.

Each plate has a hardened steel strap 35 tack welded to its upper edge to provide a supporting surface for the billet. The supporting surface has a generally horizontal central section 36, a downwardly sloping eject section 37 and a downwardly sloping grinding section 38. The billet rests upon the downwardly sloping grinding section 38 during the grinding process. While that section 38 lies in a plane which is at a slope of approximately 10° to a horizontal plane, that angle is not critical, for any downwardly sloping surface which permits the grinding operation as well as the manipulating operations will be satisfactory.

As can be seen from FIG. 2, the downwardly sloping surface supports a billet 40 in such an attitude that its upper surface 41 is sloped toward the operator for better viewing and presents an upwardly projecting corner 42 in an attitude suitable for corner grinding.

The three supporting sections 36, 37 and 38 provide a billet supporting surface 43. At the corner of each plate 25 adjacent the grinder side of the car, an abutment 45 projects above the surface 43. The abutment 45 is engageable by a billet when pushed to the position shown by a clamp arm, to be described.

A lift arm 50 has one end 52 pivotally mounted between the plates on an axis 53. The arm is mounted between a bracket 54 fixed to the tube 28 intermediate its ends and one of the plates 25. A shaft 55 is fixed between the bracket 54 and the plate 25. A bearing 56 is mounted on the shaft and the arm 50 is fixed to the bearing.

The arm 50 has a lower edge 57 presenting an ear 58 which is pivotally secured to a clevis 59 fixed on the end of a hydraulic lift cylinder 60. A piston within the lift cylinder presents a rod 61 terminating in a clevis 62 pivotally secured to a bracket 63 fixed to the block 27. The piston and lift cylinder 60 are double-acting and are adapted to swing the lift arm from the lower position to an upper position (compare FIGS. 4 and 5) to effect the rotation of a billet, as will be described.

The free end of the arm 50 has an L-shaped portion 65 terminating in an upwardly projecting or sloping leg 66. The leg 66 is integral with a downwardly sloping portion 67 presenting a right angle juncture 68. The right angle juncture between the sloping portion 67 and the leg 66 is adapted, when the arm is in its upper position shown in FIG. 5, to cradle the corner of a billet 40 and present the diagonally opposed corner in an upwardly projecting manner for corner grinding if desired. It is believed that the sloping grinding section 38 described above will normally provide the desired corner grinding attitude of the billet, but nevertheless, the capability of rotating and supporting the billet through 45° stages is available if desired.

The leg 66 terminates in a surface 69 which lies at an angle of about 105° to the arm portion 67 to provide a gentle slope for the initial rotating movement of the billet.

A clamp arm 70 is rotatably mounted between the plates 25 on an axis 71. The clamp arm 70 is fixed to a bearing 72 rotatably mounted on a shaft 73, the shaft being fixed to one of the plate 25 at one end and to a bracket 74 at the other end, the bracket in turn being fixed to the block 27. The clamp arm 70 has a lower edge 75 which presents an ear 76 pivotally joined to a clevis 77 on one end of a hydraulic double-acting clamp cylinder 78. The clamp cylinder has a piston and a projecting rod 79 terminating in a clevis 80 which is pivotally secured to a bracket 81 fixed to the block 26. Actuation of the double-acting clamp cylinder causes the clamp to move from a retracted position as shown to a clamp position of FIG. 4. During the movement from the retracted position to the clamp position, the clamp arm has a free end 84 which swings above the supporting surface 43 and moves a billet 40 against the abutment 45.

Four eject arms are supported respectively on four vertical plates 90 which are mounted to the car frame member 16. Each plate carries a bearing block 91 in which the shaft 19 is journalled. Four eject arms 18 are fixed to the shaft 19 adjacent the respective bearing blocks 91. Each eject arm is mounted on a clamp 93 formed by two clamp elements 94, 95 which are bolted together by bolts 96. Keys 97 between the clamp elements and the shaft 19 are provided to block rotation of the arm with respect to the shaft 19.

The endmost eject arms are driven by the two hydraulic arms 20, each including a double-acting cylinder 100 carrying a piston and rod 101. They cylinder 100 has a clevis 102 at one end which is pivotally connected to an ear 103 projecting from an edge of the arm 18. The rod 101 has an end terminating in a clevis 105 which is pivotally mounted on bracket 106 fixed to the frame 16 of the car.

Figure 3:
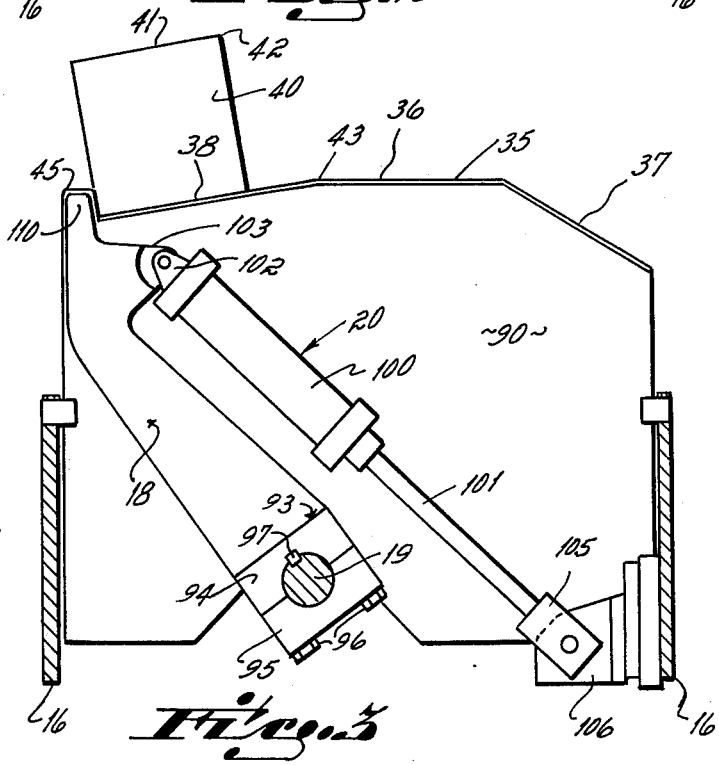
FIG. 3 is a cross-sectional view taken along lines 3—3 of FIG. 1 showing an eject arm.
Figure 8:
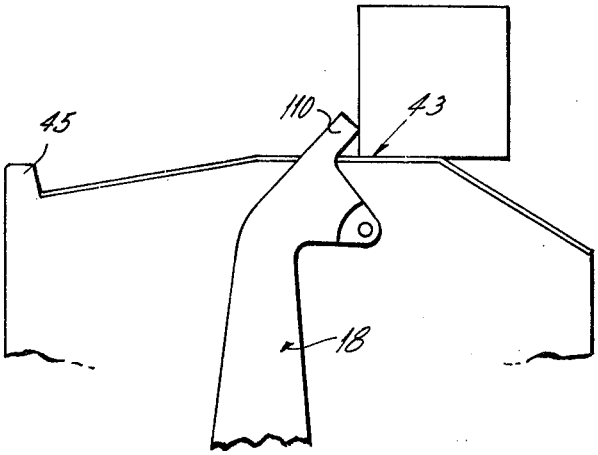

When hydraulic fluid is introduced into the cylinder 100, the eject arm 18 is caused to pivot from the position of FIG. 3 to and beyond the position of FIG. 8. The upper end of the ejected arm indicated at 110 swings across the top of the frame and projects above the surface 43 to thrust the billet from its operative position against the abutment 45 to the right as viewed in FIGS. 3 and 8 until it drops off the billet car and onto a cradle (not shown) where it is backed up by a fork lift and removed for further processing. Since all four arms 18 are fixed to shaft 19, they move together in unison, thereby assuring an ejection of the billet without cocking it as it moves over surface 43.

The hydraulic system and the like for operating the respective cylinders is not shown but is supported on the car. Thus, only festooned electrical cables are required to bring power to the system from a fixed location.

The operation of the invention is illustrated in FIGS. 4–8. In the illustrated form of the invention, the apparatus is adapted to manipulate rectangular billets, not necessarily square, which range from 6 × 6 × to 16 × 16. It should be understood that the invention is of course not restricted to manipulation of billets within that range, for with modifications well within the skill of the art, billets of greater or lesser sizes can be handled.

Figure 4:
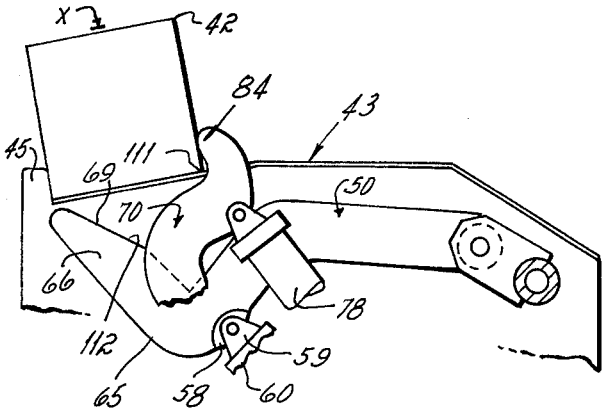
FIGS. 4–8 are diagrammatic views illustrating the operation of the manipulator mechanism.
Figure 5:
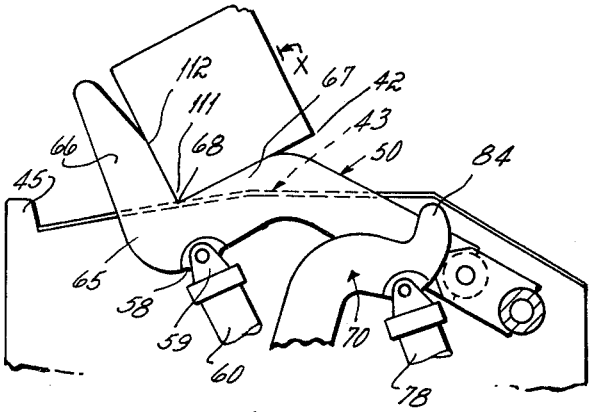

A billet is first deposited onto the surface 43 from a load table (not shown). The clamp cylinder 78 is actuated to move the billet against the abutment 45 where it is shown in FIG. 4.

When in this position, the billet car is driven longitudinally to carry the billet past the grinder where the grind wheel 12 is caused to move transversely back and forth over the surface of the billet. Because of the slope of the grinder section 38 of the support surface, the surface of the billet which the operator is grinding is easily seen by the operator. Further, because of the slope, the corner 42 projects upwardly, enabling the operator to grind off the corner during the traverse of the billet car.

At the end of a traverse of the billet car past the grinder, the clamp cylinder is reversed to swing the clamp arm 70 away from the billet. The lift cylinder 60 for the lift arm 50 is actuated to bring the projecting leg 66 under the corner of the billet closest to the operator and to swing that corner up about the adjacent corner. As the lift arm continues to swing upwardly, the billet is caused to slide along a surface 112 of the leg 66 until the corner of the billet lodges into the juncture 68 between leg 66 and portion 67. This movement is completed when the lift arm achieves the position illustrated in FIG. 5. There the corner of the billet is supported in part by the surface 43 and in part by the lift arm. Since the billet is cradled in the 90° angle formed between the leg 66 and the arm portion 67, the billet is held secure against movement and the upwardly projecting corner of the billet is available for grinding if that is desired.

In this attitude, the billet has been rotated through an angle of over 45° (about 70°) so that its center of gravity has been shifted beyond the downwardly directed corner 111. When the lift arm is retracted, the billet will continue to rotate through the remaining angle of approximately 20°, thus effecting a 90° rotation of the billet.

Figure 6:
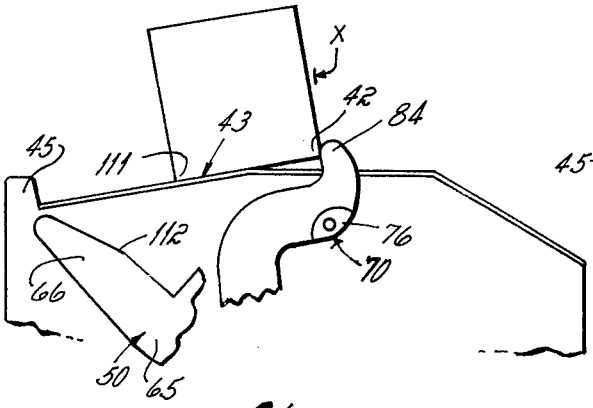
Figure 7:
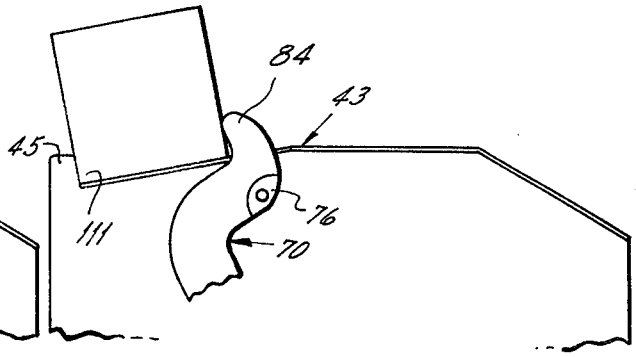

When the lift arm is retracted, the billet is in the attitude indicated in FIG. 6. Thereafter, the clamp cylinder 78 is again actuated to swing the clamp arm 70 from right to left as viewed in the figures so that the upper end 84 of the clamp arm engages the billet and moves it over to the abutment 45 where the clamp arm clamps the billet against the abutment. In this attitude, the grinding operation is once again performed by causing the billet car to move past the grinding wheel while reciprocating the grinding wheel.

These operations are repeated until the completion of the grinding operation on all surfaces of the billet. After the final grinding operation, the clamp arm 70 is retracted below the surface 43 and the eject cylinders are energized to cause the eject arm to swing from left to right, as illustrated in FIG. 8. In swinging from left to right, the projecting upper end 110 of the eject arms sweeps across the upper surface 43 of the frame, pushing the billet off the frame into a waiting cradle for further processing.

We claim:

1. A billet manipulator comprising,
a frame presenting an upper supporting surface lying generally in a horizontal plane,
a lift arm pivoted to said frame at one end and having an L-shaped free end having an upwardly projecting leg,
means for swinging said arm up and down,
said leg, upon upward movement of said arm, being engageable with the under side of a billet supported on said surface to rotate said billet through an angle greater than 45°,
said billet, upon downward movement of said arm, engaging said surface and rotating through an angle to rest on the surface of said frame.

2. A billet manipulator as in claim 1 further comprising,
an abutment on said frame projecting above said surface,
said abutment being located immediately above said upwardly projecting leg,
a clamp arm pivoted to said frame at one end and having a free end engageable with said billet on a side remote from said abutment,
and means for moving said arm toward said abutment to clamp said billet against said abutment.

3. A billet manipulator as in claim 1 in which at least a portion of said surface adjacent said lift arm slopes down and away from said lift arm pivot axis.

4. A billet manipulator as in claim 3 in which said sloping surface portion is at an angle of about 10° to a horizontal plane.

5. A billet manipulator as in claim 1 further comprising,
an eject arm pivoted at one end to said frame on an axis spaced below said surface,
said eject arm having a free end projecting above said surface and engageable with a billet, means for moving said eject arm in a direction to push said billet off said surface.

6. Billet manipulating apparatus as in claim 1 in which said leg has a first surface intersecting said arm at approximately 90° and terminates in a second surface lying at an angle of approximately 105° to said arm.

7. A billet manipulator as in claim 1,
said lift arm adapted to hold said billet in a lifted attitude presenting an upwardly directed corner, and thereafter to lower said billet to present upwardly facing, generally horizontal surface adjacent the surface which faced upwardly prior to actuation of the lift arm.

8. In billet grinding apparatus,
an elongated car for carrying a billet past a grinder,
a plurality of longitudinally spaced vertical plates mounted on said car,
said plates having upper edges presenting a generally horizontal billet supporting surface,
an abutment at one end of said surface,
at least two longitudinally spaced lift arms each pivotally mounted at one end between two of said plates, each said lift arm having an L-shaped free end with an upwardly projecting leg normally located immediately below said abutment,
each said upwardly projecting leg being engageable with a billet resting on said surface against said abutment,
means for swinging said lift arm up and down,
said projecting leg, upon upward movement, being engageable with the underside of a billet supported on said supporting surface to rotate said billet through an angle greater than 45°,
at least two clamp arms each pivotally mounted at one end between two of said plates, and having a free end projecting above said surface,
and means for swinging said arm toward and away from said abutment to clamp and release a billet.

9. Apparatus as in claim 8 in which said means for swinging said arms comprises fluid pressure-operated rams each pivoted at one end to said plates and at the other end to a respective arm.

10. Apparatus as in claim 8 further comprising,
a plurality of longitudinally spaced eject arms fixed to a shaft,
said arm having ends projecting above said supporting surface,
means for rotating said shaft to swing said arms in unsion against a billet to eject a billet from said car.

11. A billet manipulator comprising,
a frame presenting an upper supporting surface,
a lift arm pivoted to said frame at one end and having an L-shaped free end having an upwardly projecting leg,
means for swinging said arm up and down,
said leg, upon upward movement of said arm, being engageable with the under side of a billet supported on said surface to rotate said billet through an angle greater than 45°,
said billet, upon downward movement of said arm, engaging said surface and rotating through an angle to rest on the surface of said frame,
said lift arm being generally horizontal, said L-shaped free end being formed by a downwardly sloping portion and an upwardly sloping leg to form a cradle for a billet,
said upwardly sloping leg engaging a corner of said billet to swing it upwardly and to cause said billet to slide, bringing the adjacent billet corner into the juncture of said sloping portion and leg,
said swinging means adapted to hold a billet in that attitude to present a corner for grinding.

* * * * *